US010697297B2

(12) United States Patent
Hosp et al.

(10) Patent No.: US 10,697,297 B2
(45) Date of Patent: Jun. 30, 2020

(54) COMPOSITE YIELDABLE ROCK ANCHOR WITH IMPROVED DEFORMATION RANGE

(71) Applicant: Minova International Limited, Barnsley South Yorkshire (GB)

(72) Inventors: Michael Hosp, Villach (AT); Markus Unterlerchner, Seeboden (AT)

(73) Assignee: Minova International Limited, Barnsley South Yorkshire (GB)

( * ) Notice: Subject to any disclaimer, the term of this patent is extended or adjusted under 35 U.S.C. 154(b) by 0 days.

(21) Appl. No.: 16/476,697

(22) PCT Filed: Jan. 9, 2017

(86) PCT No.: PCT/EP2017/050331
§ 371 (c)(1),
(2) Date: Jul. 9, 2019

(87) PCT Pub. No.: WO2018/127294
PCT Pub. Date: Jul. 12, 2018

(65) Prior Publication Data

US 2019/0376388 A1 Dec. 12, 2019

(51) Int. Cl.
*E21D 21/00* (2006.01)

(52) U.S. Cl.
CPC ..... *E21D 21/0046* (2013.01); *E21D 21/008* (2013.01)

(58) Field of Classification Search
CPC ..... E21D 21/0046; E21D 21/008
See application file for complete search history.

(56) References Cited

U.S. PATENT DOCUMENTS 4,295,761 A * 10/1981 Hansen ..... E21D 20/025 405/259.1
4,393,638 A * 7/1983 Sell ..... F16B 13/002 52/704

(Continued)

FOREIGN PATENT DOCUMENTS

AU 2008202980 A1 1/2009
AU 2008221612 A1 4/2009

(Continued)

OTHER PUBLICATIONS

International Search Report and Written Opinion, dated Sep. 25, 2017, 11 pages.

(Continued)

*Primary Examiner* — Benjamin F Fiorello
(74) *Attorney, Agent, or Firm* — Barnes & Thornburg LLP

(57) ABSTRACT

The present invention pertains to a yieldable rock anchor (10), comprising an elongated tendon (12) extending longitudinally along a tendon axis (A) from a proximal end (16) to a distal end (18), wherein the tendon includes a substantially non-yielding rigid first anchor portion (20) at or near said distal end (18) and extending towards said proximal end (16), and at least one plastically deformable axially yielding portion (26) intermediate said non-yielding rigid first anchor portion (20) and said proximal end (16). The first anchor portion (20) may be a hollow bar member, and the first anchor portion (20) and the at least one yielding portion (26) are integrally joined or coupled to one another to form at least part of said elongated tendon (12).

12 Claims, 2 Drawing Sheets

(56) References Cited

Figure 1:
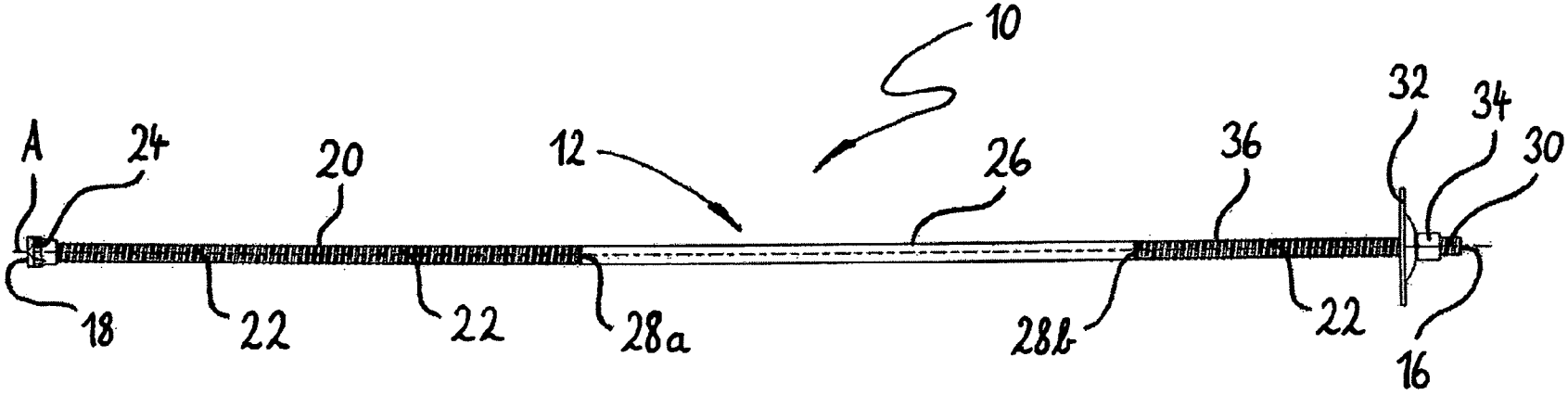

U.S. PATENT DOCUMENTS 5,483,781 A * 1/1996 Ernst ..... F16B 13/141 405/259.5
5,803,671 A * 9/1998 Gray ..... B21B 1/163 29/463
5,873,689 A * 2/1999 Mensour ..... E21D 21/008 405/259.2
6,079,907 A * 6/2000 Valero Ruiz ..... E02D 29/0233 405/258.1
6,499,267 B1 * 12/2002 Ayrle ..... F16B 13/141 405/259.5
8,087,850 B2 * 1/2012 Craig ..... E21D 21/0046 405/259.1
8,899,883 B2 12/2014 Champaigne et al.
9,677,399 B2 6/2017 Modlinski et al.
2008/0148595 A1 6/2008 De Larios et al.
2009/0220309 A1 * 9/2009 Weaver ..... E02D 5/801 405/259.3
2010/0021245 A1 * 1/2010 Li ..... E21D 21/008 405/259.5
2011/0033246 A1 * 2/2011 Locotos ..... E21D 20/00 405/259.6
2013/0028667 A1 * 1/2013 Champaigne ..... E21D 21/004 405/259.5
2016/0326873 A1 11/2016 Skogseth et al.

FOREIGN PATENT DOCUMENTS

WO 2008079021 A1 7/2008
WO 2008079201 A1 7/2008
WO 2011075810 A1 6/2011
WO 2015003726 A1 1/2015

OTHER PUBLICATIONS

International Preliminary Report on Patentability, dated Apr. 5, 2019, 14 pages.

* cited by examiner

COMPOSITE YIELDABLE ROCK ANCHOR WITH IMPROVED DEFORMATION RANGE

CROSS REFERENCE TO RELATED APPLICATION

This is a national stage entry of International Patent Application No. PCT/EP2017/050331, filed Jan. 9, 2017, the disclosure of which is incorporated herein by reference in its entirety.

The present invention relates to a yieldable rock anchor, such as for example used in mine roof and wall support applications.

Rock anchors, also referred to as rock bolts, are widely used for example in mining and tunneling for rock reinforcement purposes, in particular to stabilize the wall or roof of a gallery or tunnel. To this end, boreholes usually between two and twelve meters long are driven into a rock face. Rock bolts of corresponding length are then introduced into the boreholes and, depending on the type of rock bolt, are fastened in the borehole mechanically, e.g. by clamping or bracing, or by means of a bonding agent. The bonding agent usually is a cement grout or a synthetic resin adhesive. Well known types of rock bolts are mechanical anchors, e.g. expansion shell anchors, resin rock bolts and so-called SN anchors. Some anchors, such as the SN anchors, are usually fully grouted, i.e. grouted along their entire length in the borehole. Other anchors are only fastened in an end region of the borehole, e.g. by means of resin adhesives or mechanical fastening. Self-drilling anchors do not require a predrilled borehole. Sometimes, classifying a rock bolt as belonging to a certain type is impossible, as a large variety of rock bolts is known.

An anchor plate is often mounted onto the end of the anchor element projecting from the borehole and is clamped against the rock face by means of a nut. In this way, loads acting in the region of a wall of a gallery or tunnel may be introduced into deeper rock strata. In other words, by employing rock anchors rock strata more remote from the wall may be used for load transmission in order to minimize the risk of collapse of a gallery, tunnel or other structure.

Rock anchors must withstand both dynamic loads and static loads, such as squeezing ground and large displacements in rock strata. To better cope with in particular dynamic loads, so-called yieldable rock anchors have been developed, which, in the event of a predetermined load being exceeded, are able to yield, i.e. are able to increase their length within specific limits in order to reduce stress acting in the rock to an amount that the rock anchor can reliably handle. Yieldable rock anchors tend to have a more complex structure and are, therefore, more expensive than non-yieldable rock anchors.

Accordingly, it is an object of the present invention to provide an improved yieldable rock anchor which may easily be tailored to specific requirements.

It is a further object of the present invention to provide an improved yieldable rock anchor which is easy to use and inexpensive to manufacture.

It is a still further object of the present invention to provide an improved yieldable rock anchor which offers a significantly increased deformation range before failing.

With a view to solving the above objects, according to a first aspect the present invention provides a novel yieldable rock anchor comprising an elongated tendon extending longitudinally along a tendon axis from a proximal end to a distal end, the tendon including a substantially non-yielding rigid first anchor portion at or near said distal end and extending towards said proximal end, and at least one plastically deformable axially yielding portion intermediate said non-yielding rigid first anchor portion and said proximal end. Both the first anchor portion and the at least one yielding portion are hollow bar members, e.g. made from steel or plastic, and the first anchor portion and the at least one yielding portion are integrally joined to one another in an end-to-end manner to form at least part of said elongated tendon. Integrally joining the first anchor portion and the at least one yielding portion may for example be achieved by welding or, alternatively, by gluing the first anchor portion and the at least one yielding portion to one another.

According to a second aspect, the present invention provides a novel yieldable rock anchor comprising an elongated tendon extending longitudinally along a tendon axis from a proximal end to a distal end, the tendon including a substantially non-yielding rigid first anchor portion at or near said distal end and extending towards said proximal end, and at least one plastically deformable axially yielding portion intermediate said non-yielding rigid first anchor portion and said proximal end. The first anchor portion may be a hollow or full section bar member, e.g. made of steel, and the first anchor portion and the at least one yielding portion are coupled to one another in an end-to-end manner by means of a coupling element to form at least part of said elongated tendon. The coupling element may be a separate coupling element, in which case the coupling element may be a releasable coupling element, or may be integrally joined to either the first anchor portion or the at least one yielding portion in a unitary or non-unitary manner.

Any coupling element suitable for reliably joining the first anchor portion and the at least one yielding portion may be used. According to one preferred embodiment, the coupling element is an internally threaded sleeve, for example a steel sleeve. Alternatively, a sleeve acting as the coupling element may be crimped or press fitted to at least one of the first anchor portion and the at least one yielding portion. Still further, coupling elements may be glued to at least one of the first anchor portion and the at least one yielding portion to effect coupling. Coupling elements may have roughly the same outer diameter as the first anchor portion and the at least one yielding portion, but may also have a larger or smaller outer diameter. Specifically designing the coupling elements to have a larger outer diameter than the adjoining anchor portion and yielding portion may be beneficial in that additional anchor points along the tendon may thus be created, resulting in improved retention of the tendon within a borehole.

According to the second aspect of the present invention, the at least one yielding portion may be embodied as for example a steel bar member which may have a full section or may be a hollow bar member. The at least one yielding portion may alternatively be embodied as a profile member, e.g. made of steel, a rope or strand member, or a fiber reinforced plastic member. A fiber reinforced plastic member forming the at least one yielding portion may for example be a carbon fiber reinforced plastic member, such as a carbon composite member.

As will be understood by persons skilled in the art from the above explanations, the tendon of yieldable rock anchors according to both the first and the second aspect of the present invention is of composite or fabricated structure, which results in the various advantages set out below. By composite or fabricated structure we mean that the tendon is a non-unitary structure including a plurality of separate members (such as the first anchor portion and the at least one yielding portion) which are rigidly joined to one another in an end-to-end manner to form at least part of said elongated tendon.

A yieldable rock anchor according to the present invention may take the form of a pretensionable rock bolt, e.g. in accordance with European standard EN 1537, or may take the form of an elongating soil nail, but may also take any other form in which the substantially non-yielding rigid first anchor portion at or near the distal end of the tendon is bonded to the surrounding rock structure to firmly anchor the tendon in place whereas the at least one plastically deformable axially yielding portion is suitably decoupled from the surrounding rock structure so as to allow yielding by axial elongation of the yielding portion. The term 'suitably decoupled' is meant to encompass situations in which an outer surface of the yielding portion(s) is prevented from any bonding contact with the surrounding rock structure, but shall also encompass situations in which there is bonding contact between the outer surface of the yielding portion(s) and the surrounding rock structure. In the latter case, however, any bonding contact between the outer surface of the yielding portion(s) and the surrounding rock surface under load must break up well before the bonding contact between the outer surface of any rigid anchor portion and the surrounding rock structure. Preferably, the yieldable rock anchor of the present invention is of the self-drilling variety.

In addition to the substantially non-yielding rigid first anchor portion, the tendon may include at least one substantially non-yielding rigid further anchor portion located intermediate said proximal end and the at least one yielding portion. Typically, the at least one substantially non-yielding rigid further anchor portion will be arranged at or near the proximal end of the tendon, and may take the form of an externally threaded portion configured to cooperate with an anchor plate and nut arrangement used to clamp the yieldable rock anchor against a rock face and to apply a desired amount of pretension. In other forms, the yieldable rock anchor according to the present invention may include an externally threaded portion at or near the tendon's proximal end, and may include the at least one substantially non-yielding rigid further anchor portion separate from the externally threaded portion. Also, a plurality of substantially non-yielding rigid further anchor portions may be provided along the tendon's length spaced from each other. The or any substantially non-yielding rigid further anchor portion may be integrally joined or coupled to an adjoining anchor portion in an end-to-end manner in just the same way as the substantially non-yielding rigid first anchor portion.

Preferably, the non-yielding rigid first anchor portion and, if applicable, the at least one or any substantially non-yielding rigid further anchor portion is provided with a plurality of anchoring members protruding from an outer surface of the respective anchor portion to enhance fixing interaction between the anchor portion, the bonding agent and the surrounding rock structure. Anchoring members are preferably selected from the group of ribs, grooves, slots, indentations, threads, bosses and studs. Anchoring members may for example be formed onto the outer surface of an anchor portion by a cold rolling process which in addition to providing the desired anchoring members will increase the strength of an anchoring portion by reducing plasticity along the anchor portion.

Contrary to the substantially non-yielding rigid anchor portions, the at least one or each plastically deformable axially yielding portion preferably has a generally smooth outer surface facilitating decoupling and allowing for a more predictable and consistent axial deformation. Due to its integrally joined or coupled construction, the yieldable rock anchor according to the present invention allows to prefabricate anchor portions provided with a plurality of anchoring members by for example cold rolling a continuous length of bar stock which is subsequently cut into anchor portions of desired length. Likewise, yielding portions may be prefabricated by cutting bar stock having a generally smooth outer surface into pieces of desired length. The prefabricated anchor portions and the prefabricated yielding portions may then be integrally joined or coupled to one another to form the elongated tendon of a yieldable rock anchor according to the present invention. This allows to quickly and cost efficiently manufacture yieldable rock anchors of any desired length which offer superior deformation characteristics, since any desired number of yielding portions and/or anchor portions may easily be provided and the length and/or diameter of the anchor portion(s) and the yielding portion(s) may easily be varied as needed for a given application. Also, while the diameter of all anchor portion(s) and all yielding portion(s) may be the same, it is contemplated that for example some or all yielding portions may have a smaller or larger diameter than the anchor portion(s). Further, not all anchor portions need to have the same diameter. Instead, the length and/or diameter of both the anchor portion(s) and the yielding portion(s) may be varied on any given tendon to best suit a particular application. Still further, different materials may conveniently be used in forming the anchor portion(s) and the yielding portion(s), such that desired characteristics of the anchor portion(s) and the yielding portion(s), respectively, may be custom tailored to specific applications. Different materials may be different type of steels, but may also combinations of steel and plastic materials or combinations of non-steel materials. Even if the same type of steel is used for both the anchor portion(s) and the yielding portion(s), the anchor portion(s) will show a significantly higher strength than the yielding portion(s), due to the fact that cold rolling or otherwise press forming anchoring members onto the outer surface of bar stock results in increased strength and reduced plasticity of the bar stock subjected to these operations. On the other hand, using pieces of bar stock not subjected to cold rolling or other press forming operations as yielding portions will result in those pieces having greater plasticity and reduced strength compared to the anchor portions, thus ensuring that under load the yielding portion(s) will axially deform as desired while the anchor portion(s) will be rigid, i.e. substantially non-yielding.

Preferred embodiments of the yieldable rock anchor according to the present invention may include a plurality of substantially non-yielding rigid further anchor portions and a plurality of plastically deformable axially yielding portions, preferably in alternating arrangement. Every plastically deformable axially yielding portion may take the form of the at least one yielding portion as described above, that is, every yielding portion may take the form of a bar member, for example a steel bar member of hollow or full cross section, or may take the form of a profile member, a rope or strand member or a member made of fiber reinforced plastics material, such as a carbon composite member. Combinations are possible, that is, one or more yielding portions may for example be embodied as hollow bar members made of steel or fiber reinforced plastic, whereas other yielding portions may be embodied as profile members or rope or strand members, as desired and suitable for a given application. It will be understood from what has been described above that embodiments including a plurality of anchor portions and a plurality of yielding portions in alternating arrangement may be readily and inexpensively obtained in any desired length by integrally joining or coupling prefabricated anchor portions and prefabricated yielding portions to one another as discussed above.

Using any of the above described members as the at least one or any yielding portion and hollow members as the first anchor portion and the at least one or a plurality of further anchor portion(s) significantly contributes to obtaining the superior deformation characteristics. To give an example, in the yieldable rock anchor according to the present invention the at least one yielding portion preferably has a deformation range of at least 100 mm/m, more preferably of at least 120 mm/m, and most preferably of at least 150 mm/m, corresponding to an axial deformation of 10%, 12% and 15%, respectively. Heretofore, axial deformations in the range of 0.3% to approximately 2% were known from the prior art. It follows that the yieldable rock anchor according to the present invention represents a huge improvement over prior art yieldable rock anchors.

While it has been explained above that anchor portions and yielding portions may be made of the same type of steel, it is also possible for hollow bar members constituting the at least one yielding portion to be made from steel that is different from the steel used for making the hollow bar members constituting the first anchor portion and any further anchor portion. Specifically, steel showing superior yielding properties may be used to prefabricate hollow bar members intended to form yielding portions, whereas steel showing superior strength may be used for prefabricating hollow bar members intended to form substantially non-yielding anchor portions. Again, due to the integrally joined or coupled construction of the yieldable rock anchor according to the present invention, hollow bar members made from different types of steel may readily and inexpensively be joined to one another, as desired. Still further, and likewise due to the integrally joined or coupled construction, hollow bar members intended to form yielding portions may be heat treated to thus reduce strength and increase plasticity, while non-heat treated hollow bar members may be used for forming anchor portions. As will be understood by persons skilled in the art, the integrally joined or coupled construction of the yieldable rock anchor according to the present invention provides for a great deal of flexibility in designing custom tailored yieldable rock anchors.

While in many embodiments of yieldable rock anchors according to the present invention the outer diameters of the anchor portion(s) and the yielding portion(s) will be at least roughly the same, in other embodiments the at least one or at least one or every yielding portion may have an outer diameter that is smaller or larger than an outer diameter of an adjacent rigid anchor portion. Appropriately selecting the outer diameter of a yielding portion to be smaller or larger than the outer diameter of an adjacent anchor portion represents a further possibility to fine-tune deformation characteristics of the respective yielding portion.

Currently preferred embodiments of a yieldable rock anchor according to the present invention will now be described in more detail with reference to the accompanying schematic figures.

Figure 2:
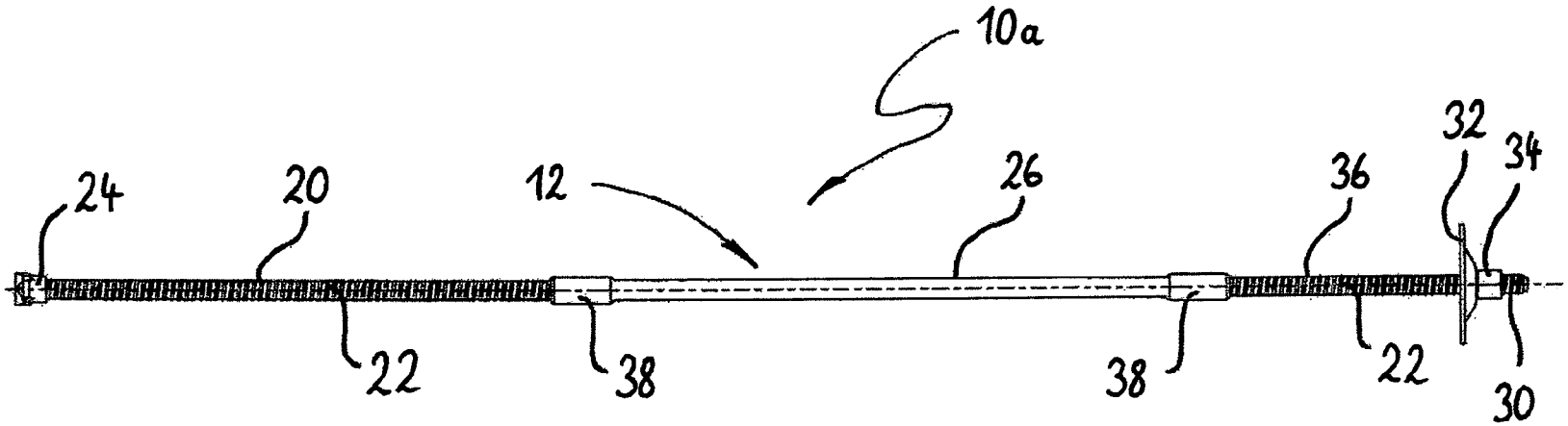
Figure 3:
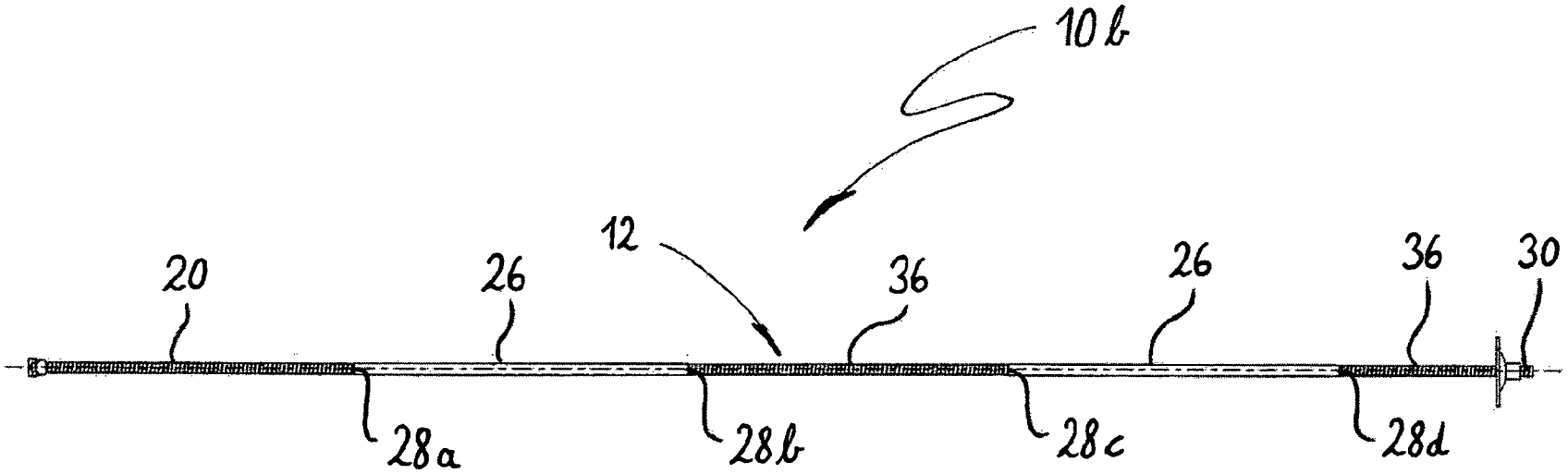

FIG. 1 shows a side view of a first embodiment of a yieldable rock anchor according to the present invention, FIG. 2 shows a side view of a second embodiment of a yieldable rock anchor according to the present invention, and FIG. 3 shows a side view of a third embodiment of a yieldable rock anchor according to the present invention including multiple yielding portions.

FIG. 1 shows a side view of a first embodiment of a yieldable rock anchor, or rock bolt, generally designated at 10. The rock anchor 10 includes an elongated tendon 12 extending longitudinally along a tendon axis A from a proximal end 16 to a distal end 18. The tendon 12 is preferably fabricated from metal, such as a steel bar, however other bar constructions are possible. While the tendon 12 will usually have an at least essentially circular cross section, the present invention is not limited to tendons having a circular cross section.

At or near the distal end 18 and extending in the direction of the proximal end 16, the tendon 12 has a substantially non-yielding rigid first anchor portion 20 intended to firmly anchor the tendon in place. The first anchor portion 20 is made from a hollow bar member and is provided, on an outer surface thereof, with a plurality of anchoring members 22 which in the embodiment shown take the form of ribs, such as on a conventional rebar, but may also take the form of grooves, slots, indentations, threads, bosses and studs. The anchoring members 22 are provided to enhance a fixing action between the first anchor portion, a bonding agent such as grout or resin, and the surrounding rock structure. As is well-known to skilled persons in the field to which the present invention pertains, grout or resin is used to fasten a rock anchor in a borehole.

In the embodiment shown, the rock anchor 10 is of the self-drilling variety, and to this end includes a drilling head 24 mounted to the distal end 18 of the tendon 12.

Extending from the substantially non-yielding rigid first anchor portion 20 towards the proximal end 16 is a plastically deformable axially yielding portion 26 which is also made from a hollow bar member but has a generally smooth outer surface. In the embodiments shown, both the hollow rigid first anchor portion 20 and the hollow yielding portion 26 are made of steel and are welded to one another at weld **28*a* to thus form at least a part of the elongated tendon 12. Alternatively, the hollow rigid first anchor portion 20 and the hollow yielding portion 26 may be glued to one another. In the embodiment shown, the yielding portion 26 has essentially the same outer diameter as the first anchor portion 20, but it is also possible for the yielding portion to have an outer diameter that is smaller than the outer diameter of the rigid anchor portion 20**.

A proximal externally threaded end portion 30 includes the proximal end 16 and is joined, either integrally or by welding as shown at **28*b*, to the yielding portion 26. In use, the proximal end 16 projects outwardly beyond a rock face and is configured, by way of the externally threaded portion 30, to cooperate with an anchor plate 32 and a threadingly engagable nut 34 used to clamp the proximal end of the rock anchor 10 against the rock face and to apply a suitable pretension, if desired. The externally threaded portion 30 of the tendon 12 may in use act as a substantially non-yielding rigid further anchor portion 36 to the extent it is located within a borehole (not shown), that is in an area extending approximately from the anchor plate 32 towards the distal end 18. Accordingly, the yieldable rock anchor 10 shown in FIG. 1 includes the at least substantially non-yielding first anchor portion 20 closest to the toe of the borehole, i.e. closest to the distal end 18 of the tendon 12, as well as the plastically deformable axially yielding portion 26 located intermediate the first anchor portion 20 and the proximal end 16, and an at least substantially non-yielding rigid further anchor portion 36 located intermediate the proximal end 16 and the yielding portion 26**.

In order for the rock anchor 10 to operate as intended, both the first anchor portion 20 and the further anchor portion 36, regardless of the material used to make them, must have a strength which is sufficiently higher than a strength of the yielding portion 26 to ensure that it is the plastically deformable yielding portion 26 which lengthens or elongates axially with dilating rock, to thereby accommodate and absorb the rock forces without having the rock anchor 10 fail. Considering strength tolerance bands of the first anchor portion and any further anchor portion as well as of the at least one yielding portion, it is important to ascertain that the tolerance bands of the anchor portions and the yielding portion(s) do not overlap. Also, it is necessary that in use the yielding portion 26, or any yielding portion for that matter, forms a debonded section whereas the first anchor portion and any further anchor portion forms a bonded section, i.e. bonded to the surrounding rock structure. To this end, the yielding portion 26 has a generally smooth outer surface, thus facilitating debonding. To further enhance debonding capabilities, the outer surface of the yielding portion 26, or any yielding portion, may be suitably coated to reduce friction, for example by applying a thin layer of oil or another non-stick material.

There are different ways to ensure that the strength of the first anchor portion and any further anchor portion is sufficiently higher than that of the or any yielding portion. For example, if anchoring members 22 in the form of ribs or threads are provided on anchor portions 20, 36, they may be formed onto the outer surface of the respective anchor portion by using a cold rolling process (or any other suitable press forming operation), by which the strength of the hollow bar member forming an anchor portion is increased and its plasticity reduced when compared to a hollow bar member which consists of the same type of steel and has not been subjected to a cold rolling process. Further, hollow bar members intended to form yielding portions may be heat-treated, thus increasing their capability to plastically deform by decreasing strength. Still further, different types of steel may be used as anchor portions and as yielding portions, respectively, with steel used for yielding portions having a greater elongation and lower strength than steel used for anchor portions. Combinations of those possibilities are also possible, allowing to custom tailor the tendon 12 to particular applications. Tests conducted by the applicant have shown that 22MnB5 steel is particularly suitable to be used in the present invention for forming both anchor portions and yielding portions.

In tests conducted by the applicant, yieldable rock anchors 10 according to the present invention were found to allow elongations of between 120 mm/m and 150 mm/m, corresponding to an axial deformation of between 12% and 15%, respectively. This is considered a huge improvement over prior art yieldable rock anchors which allow axial deformations in the range of approximately 0.3% to 2%.

FIG. 2 shows a side view of a second embodiment of a yieldable rock anchor 10*a* which differs from the rock anchor 10 of FIG. 1 in that the substantially non-yielding rigid first anchor portion 20 and the plastically deformable axially yielding portion 26 are not welded to one another, but are instead coupled to one another using a separate coupling element, which in the embodiment shown is an internally threaded steel sleeve 38. Likewise, the axially yielding portion 26 is not welded to the further anchor portion 36 as in FIG. 1, but is instead coupled to the further anchor portion 36 using another coupling element, embodied here as another internally threaded steel sleeve 38. As shown in FIG. 2, both sleeves 38 are formed as end pieces of the axially yielding portion 26 having a larger outer diameter than the remainder of the axially yielding portion, and are integrally joined to the axially yielding portion by welding, but could also be embodied as separate members, e.g. as steel sleeves which are not integral end pieces of the axially yielding portion 26 (not shown). Here, both sleeves 38 are made of a type of steel that is different from the steel used for forming the axially yielding portion 26 in order to ensure that any yielding is restricted to the axially yielding portion 26. Alternatively, the coupling elements could be sleeves made from fiber reinforced plastics material (not shown), and instead of using internally threaded sleeves, crimped sleeves could for example be used. Any other coupling element capable of reliably joining or coupling a non-yielding anchor portion to an axially yielding portion may be used in the context of the present invention.

FIG. 3 shows a side view of a third embodiment of a yieldable rock anchor 10*b* according to the present invention, which is similar to the first embodiment shown in FIG. 1, but includes, in addition to the substantially non-yielding rigid first anchor portion 20, a plurality of substantially non-yielding rigid further anchor portions 36 as well as a plurality of plastically deformable axially yielding portions 26 in alternating arrangement. In FIG. 3, two non-yielding further anchor portions 36 and two axially yielding portions 26 are shown, but any number of such further anchor portions and axially yielding portions is contemplated. Just like the embodiment shown in FIG. 1, the anchor portions and axially yielding portions of FIG. 3 are welded (or glued) to one another at welds 28*a*-28*d*, but could also be coupled to one another by means of coupling elements, as shown in FIG. 2.

Typically, an axially yielding portion 26 may have a length of one meter, but may also be shorter or longer. Also, the length and/or diameter of both the anchor portions and the yielding portions forming the tendon 12 may vary, that is, each anchor portion and each the yielding portion need not have the same length and/or diameter.

The invention claimed is:

1. A yieldable rock anchor, comprising:

a non-unitary elongated tendon extending longitudinally along a tendon axis from a proximal end to a distal end, the tendon including a substantially non-yielding rigid first anchor portion at or near said distal end and extending towards said proximal end, and at least one plastically deformable axially yielding portion intermediate said non-yielding rigid first anchor portion and said proximal end, wherein both the first anchor portion and the at least one yielding portion are hollow bar members, and wherein the first anchor portion and the at least one yielding portion are integrally joined to one another in an end-to-end manner by welding or gluing to form at least part of said elongated tendon, wherein strength tolerance bands of the substantially non-yielding rigid anchor portion and the at least one plastically deformable axially yielding portion do not overlap, and wherein the at least one axially yielding portion has a deformation range of at least 100 mm/m.

2. The yieldable rock anchor according to claim 1, wherein the rock anchor is self-drilling.

3. The yieldable rock anchor according to claim 1, wherein the tendon includes at least one substantially non-yielding rigid further anchor portion intermediate said proximal end and said at least one yielding portion.

4. The yieldable rock anchor according to claim 3, wherein the tendon includes a plurality of substantially non-yielding rigid further anchor portions and a plurality of plastically deformable axially yielding portions in alternating arrangement.

5. The yieldable rock anchor according to claim 3, wherein the at least one substantially non-yielding rigid further anchor portion is provided with a plurality of anchoring members protruding from an outer surface of the respective further anchor portion.

6. The yieldable rock anchor according to claim 1, wherein the non-yielding rigid first anchor portion is provided with a plurality of anchoring members protruding from an outer surface of the first anchor portion.

7. The yieldable rock anchor according to claim 6, wherein the plurality of anchoring members include protuberances selected from the group of ribs, grooves, slots, indentations, threads, bosses and studs.

8. The yieldable rock anchor according to claim 1, wherein the at least one yielding portion has a generally smooth outer surface.

9. The yieldable rock anchor according to claim 1, wherein the at least one yielding portion has an outer diameter that is smaller than an outer diameter of the first rigid anchor portion.

10. The yieldable rock anchor according to claim 1, wherein the first anchor portion has a higher strength than the at least one yielding portion.

11. The yieldable rock anchor according to claim 1, wherein the at least one yielding portion and the first anchor portion are steel hollow bar members, the steel of the hollow bar members constituting the at least one yielding portion being different from the steel of the hollow bar members constituting the first anchor portion.

12. The yieldable rock anchor according to claim 1, wherein the tendon includes an externally threaded portion at or near said proximal end.

* * * * *